US007185777B2

(12) United States Patent
Itokawa et al.

(10) Patent No.: US 7,185,777 B2
(45) Date of Patent: Mar. 6, 2007

(54) SYNTHETIC RESIN BOTTLE WITH GRIP

(75) Inventors: Junichi Itokawa, Koto-ku (JP); Yoshinori Matsuo, Koto-ku (JP); Takao Iizuka, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/529,560

(22) PCT Filed: Sep. 25, 2003

(86) PCT No.: PCT/JP03/12266

§ 371 (c)(1),
(2), (4) Date: Aug. 12, 2005

(87) PCT Pub. No.: WO2004/031039

PCT Pub. Date: Apr. 15, 2004

(65) Prior Publication Data

US 2006/0011574 A1 Jan. 19, 2006

(30) Foreign Application Priority Data

Sep. 30, 2002 (JP) ..... 2002-285441

(51) Int. Cl.
*B65D 23/10* (2006.01)
*B65D 1/02* (2006.01)

(52) U.S. Cl. ..... 215/398; 215/381; 220/771

(58) Field of Classification Search ..... 215/381, 215/384, 396–398; 220/669, 675, 770, 771
See application file for complete search history.

(56) References Cited

U.S. PATENT DOCUMENTS 5,060,453 A * 10/1991 Alberghini et al. ..... 53/440
5,535,901 A * 7/1996 Ishii et al. ..... 215/396
D439,521 S * 3/2001 Takahashi et al. ..... D9/531
2002/0070193 A1* 6/2002 Mero ..... 215/381
2004/0195199 A1* 10/2004 Maki et al. ..... 215/381

FOREIGN PATENT DOCUMENTS

| | | | |
|---|---|---|---|
| JP | A 6-198720 | | 7/1994 |
| JP | 07080921 | A * | 3/1995 |
| JP | A 7-137725 | | 5/1995 |
| JP | A 8-11889 | | 1/1996 |
| JP | A 9-272543 | | 10/1997 |
| JP | 2000016434 | A * | 1/2000 |
| JP | 2000313054 | A * | 11/2000 |
| JP | A 2000-335584 | | 12/2000 |
| JP | A 2001-328636 | | 11/2001 |

* cited by examiner

*Primary Examiner*—Sue A. Weaver
(74) *Attorney, Agent, or Firm*—Oliff & Berridge, PLC

(57) ABSTRACT

A synthetic resin bottle has a grip assembled and fixed in an upright orientation to the center part of a concave region at the ear portion of a substantially cylindrical trunk portion of the bottle main body. A shoulder portion in the bottle main body has a lower circumferential wall with a truncated pyramid shape defined by a plurality of panels. A right/left center axis of a rear surface panel is placed at substantially at the center of the rear surface of the bottle main body. A center portion of each of the panels is formed as a protrusion having a convex shape gradually bulging outwards of the bottle main body.

11 Claims, 7 Drawing Sheets

SYNTHETIC RESIN BOTTLE WITH GRIP

BACKGROUND ART

1. Technical Field

The present invention relates to a synthetic resin bottle with a grip, and more particularly to a synthetic resin bottle having a grip that is fixed to a concave region provided at a rear part of a trunk portion of a bottle main body.

2. Prior Art

As a method for manufacturing bottles with a grip, there has been already known, e.g., a method wherein a grip injection-molded into a predetermined shape in advance is used as an insert material and a synthetic resin bottle main body is subjected to biaxial stretch-blow molding, or a method wherein a bottle main body and a grip are separately molded and the both members are assembled in a later stage. Further, in recent years, in view of convenience in carriage, storage, display and use, a bottle having a structure wherein a concave region is provided at a rear part of a bottle main body and serves to accommodate a grip therein is widely used.

For example, Japanese Patent Application Laid-open No. 2001-328636 describes a bottom provided with a grip in which a pair of assembled beam pieces integrally provided so as to unfurl arms to right and left sides of a grip plate are used as insert portions. Furthermore, Japanese Patent Application Laid-open No. 2000-335584 describes a bottle provided with a grip in which protrusion portions provided above and below a grip plate are used as insert portions.

Recently, in the field of alcoholic beverages, juice drinks and any other refreshing drinks in particular, there are increasing needs for larger containers, though the weight after filling the content also increases as the capacity becomes larger and, hence, higher buckling strength is demanded taking into consideration carriage, storage, etc., of the containers in a stacked state.

In particular, in the case of the above-described bottles with a grip, the concave region formed and recessed at the bottom main body exhibits significant influence. Hence, there is an increasing demand for further enhanced buckling strength in the area extending from an upper end portion of the concave region to a shoulder portion of the bottle where the support from the lower side would otherwise be insufficient.

DISCLOSURE OF THE INVENTION

The present invention has been achieved in order to eliminate the above-described drawbacks in the prior art, and it is therefore an object of the present invention to provide an increased buckling strength in the vicinity of the shoulder portion on the rear surface of the bottle main body, and thereby provide a synthetic resin bottle with a grip having a high buckling strength, which is excellent in safety and handling properties even in case of a large container with a capacity of several litters.

In order to achieve the above-described object, according to the present invention, there is provided a synthetic resin bottle with a grip, wherein a bottle main body including a substantially cylindrical trunk portion is formed with a concave region at a rear part of the trunk portion, and a grip is assembled and fixed in an upright orientation to a center position of the concave region at a rear surface side of the bottle main body: wherein a shoulder portion in the bottle main body has a lower circumferential wall with a truncated pyramid shape defined by a plurality of panels including a rear surface panel; wherein a right/left center axis of the rear surface panel is placed at substantially the center of the rear surface of the bottle main body; and wherein a center portion of each of the panels is formed as a protrusion having a convex shape gradually bulging outwards of the bottle main body.

In the bottle in which the grip is assembled and fixed in an upright orientation to the center position of the rear surface of the bottle main body of the concave region formed at the rear part of the trunk portion, although the grip also serves as a structure for supporting the load, the buckling strength tends to be reduced due to the influence of the concave region, and such tendency becomes prominent as a size of the bottle is increased.

Although the shape of the shoulder portion is of frustoconical shape in which the diameter extends from a mouth portion toward the trunk portion in many cases, a part positioned above the concave region of the bottle main body is deformed and thereby inclined in a direction where the concave region exists, i.e., toward the rear side of the bottle, when a load is applied to the bottle from above, and a stress concentration occurs at the center of the rear surface of the shoulder portion in particular, thereby generating buckling.

The configuration according to the present invention has been conceived taking the buckling generation mechanism into consideration, and a stress generated due to a load is dispersed based on the following effects, thereby improving the buckling strength.

First, when the cross-section of the lower circumferential wall of the shoulder portion having a shape whose diameter is increased downwards is formed into a polygonal shape and the lower circumferential wall is defined by a plurality of panels, then a vertical edge line is formed on the boundary between adjacent panels, an upper edge line is formed on the boundary between the panel and the upper wall surface of the shoulder portion with a frustoconical shape whilst a lower edge line is formed on the boundary between the panel and a wall surface of an upper end portion of the trunk portion, so that each panel has a substantially trapezoidal shape. Moreover, a network of the edge lines formed to the shoulder portion in this manner demonstrates a rib-like function, to thereby support the load while effectively dispersing stresses.

In particular, when a center portion of each panel is formed as a protrusion having a convex shape gradually bulging outwards of the bottle main body, the surface rigidity of the panel itself with respect to a vertical force applied to the bottle can be improved, and hence the stress dispersion function can be further effectively demonstrated.

Further, since a rear surface panel of the plurality of panels is arranged so that the right/left center axis of this panel is positioned at the center of the rear surface of the bottle main body, the center of the rear surface of the bottle main body where stress concentration occurs by the load is positioned at the center portion of a pair of right and left vertical edge lines in this rear panel, and the stresses are thus dispersed toward the right and left vertical edge lines, thereby realizing an improved buckling strength.

It is to be noted that, if the panel is arranged so that the vertical edge line is placed at the center position of the rear surface of the bottle main body, stress concentration occurs at the vertical edge line portion so that high buckling strength cannot be obtained.

When embodying the present invention, it is preferred to symmetrically arrange even-numbered panels on the front half side of the bottle main body, and symmetrically arrange odd-numbered panels on the rear half side.

Although the number and arrangement positions of the panels can be appropriately determined while taking a level of an improvement in buckling strength, an appearance of the bottle as well as the moldability of the bottle main body into account, the above-described preferred structure makes it possible to realize a bottle, in which the load can be further evenly dispersed by symmetrically arranging the panels and placing one vertical edge line at the center of a front surface of the bottle main body, and which provides an excellent appearance.

In the above-described preferred structure, it is preferred to symmetrically arrange four panels on the front half side of the bottle main body and symmetrically arrange five panels on the rear half side of the same so that the bottle can have a nonagonal shape.

In this case, it is possible to readily realize a bottle which is superior in the appearance and the moldability and has the improved effect of the buckling strength. Here, when the number of panels is too small, there is a problem that the appearance and the unevenness of a wall thickness in the bottle main body to be blow-molded become prominent and, on the other hand, when the number of panels is too large, a shape close to a frustoconical shape is obtained, and the stress dispersion effect by the vertical edge line is decreased.

When embodying the present invention, it is preferred to set a height of the protrusion at the center portion of the panel, i.e., a projection quantity to 0.2 to 2 mm.

Although the height of the protrusion at the center portion of the panel can be appropriately determined while taking a level of an improvement in buckling strength and the shape and the appearance of the bottle into account, the buckling strength improving effect can be further increased and the bottle having the excellent appearance can be realized when the height is set to 0.2 to 2 mm.

When embodying the present invention, it is preferred to form the bottle main body into a shape that a vertical protrusion is provided at the center portion of a concave region bottom surface of the concave region, form the grip into a shape that a grip plate is integrally provided between upper and lower ends of a pair of assembled beam pieces arranged in parallel in an upright orientation and a fitting protrusion which serves as a secure assembled portion having an undercut shape with respect to the concave region bottom surface of the bottle main body is provided to each of the pair of assembled beam pieces, and constitute an insert portion with respect to the concave region bottom surface part close to the vertical protrusion of the bottle main body by using a part of the assembled beam piece and the fitting protrusion.

In the above-described preferred structure, since the pair of assembled beam pieces which have the high buckling strength and are integrally provided to the grip plate are assembled and fixed so as to hold from the both sides the vertical protrusion protruding at the center portion of the concave region bottom surface of the concave region of the bottle main body with the fitting protrusion being used as a secure assembled portion having the undercut shape, the assembling strength of the grip is high, thereby obtaining the bottle with the grip which can be readily insert-molded.

In the above-described preferred structure, it is desirable to configure the fitting protrusion so that a fitting projection whose cross-section has a substantially right-angled-triangular shape is provided in the vicinity of a corner portion formed by an opposing side surface and an end surface of each of the pair of assembled beam pieces in such a manner that one side forming a right angle substantially vertically protrudes from the opposing side surface and the other side substantially vertically protrudes from the end surface.

In this case, a deformation can be achieved along the outer periphery of the fitting protrusion on the initial stage of stretch deformation of a preform by arranging an end portion of the fitting protrusion to be closer to the outer peripheral surface of the preform when the grip is set in a blow split mold and providing a simple shape to the fitting protrusion as a whole, and the resin can sufficiently reach the undercut portion, thereby obtaining the assembling strength which can sufficiently cope with a larger container.

BRIEF DESCRIPTION OF THE DRAWINGS

One embodiment according to the present invention will be described in detail hereinafter with reference to the accompanying drawings.

BEST MODE FOR CARRYING OUT THE INVENTION

Figure 1:
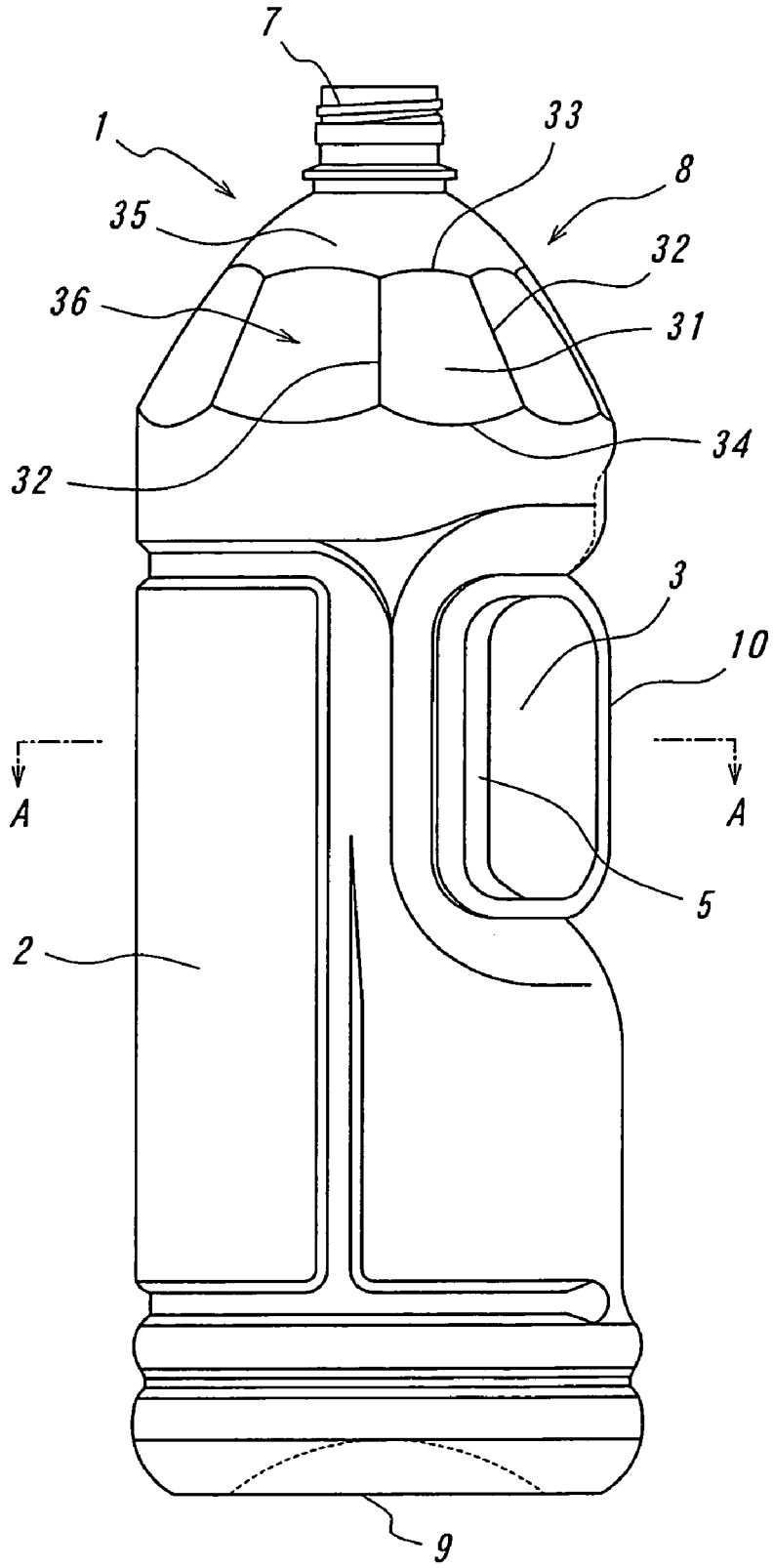
FIG. 1 is a side view showing an embodiment of a synthetic resin bottle with a grip according to the present invention.
Figure 2A:
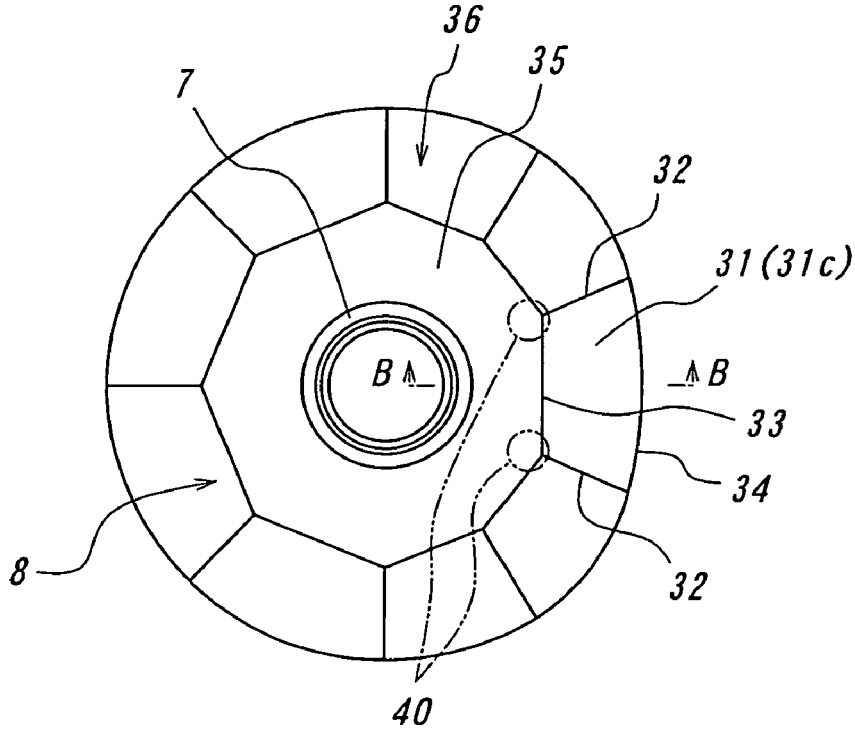
FIGS. 2*a* and 2*b* are a plan view and a primary part side view of the embodiment depicted in FIG. 1, respectively.
Figure 2B:
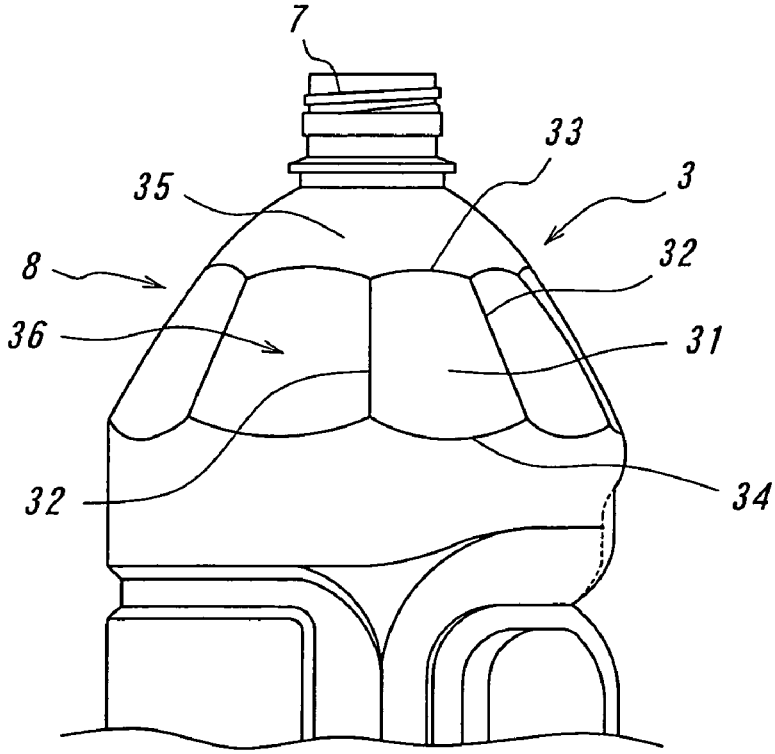

A bottle according to an embodiment depicted in FIGS. 1 and 2*a*, 2*b* comprises a bottle main body 1 in the form of a biaxial-stretch-blow-molded product which is large in size (not less than 1 litter) and formed of polyethylene terephthalate resin. A grip 10, located below a mouth 7 of the bottle main body 1, in the form of an injection-molded piece of synthetic resin is assembled and fixed by an insert-molding means, to a concave region 3 formed at a rear part of a trunk portion 2 having a substantially cylindrical shape with a bottom 9 in the bottle main body 1.

The concave region 3 of the bottle main body 1 is configured by providing a vertical protrusion 5 having a relatively wide projecting shape in the vertical direction so as to bulge over the entire height range of the concave region 3 with a substantially constant height at the center of a concave region bottom surface 4 in which a center part excluding both upper and lower end portions forms an upright flat surface.

Figure 5:
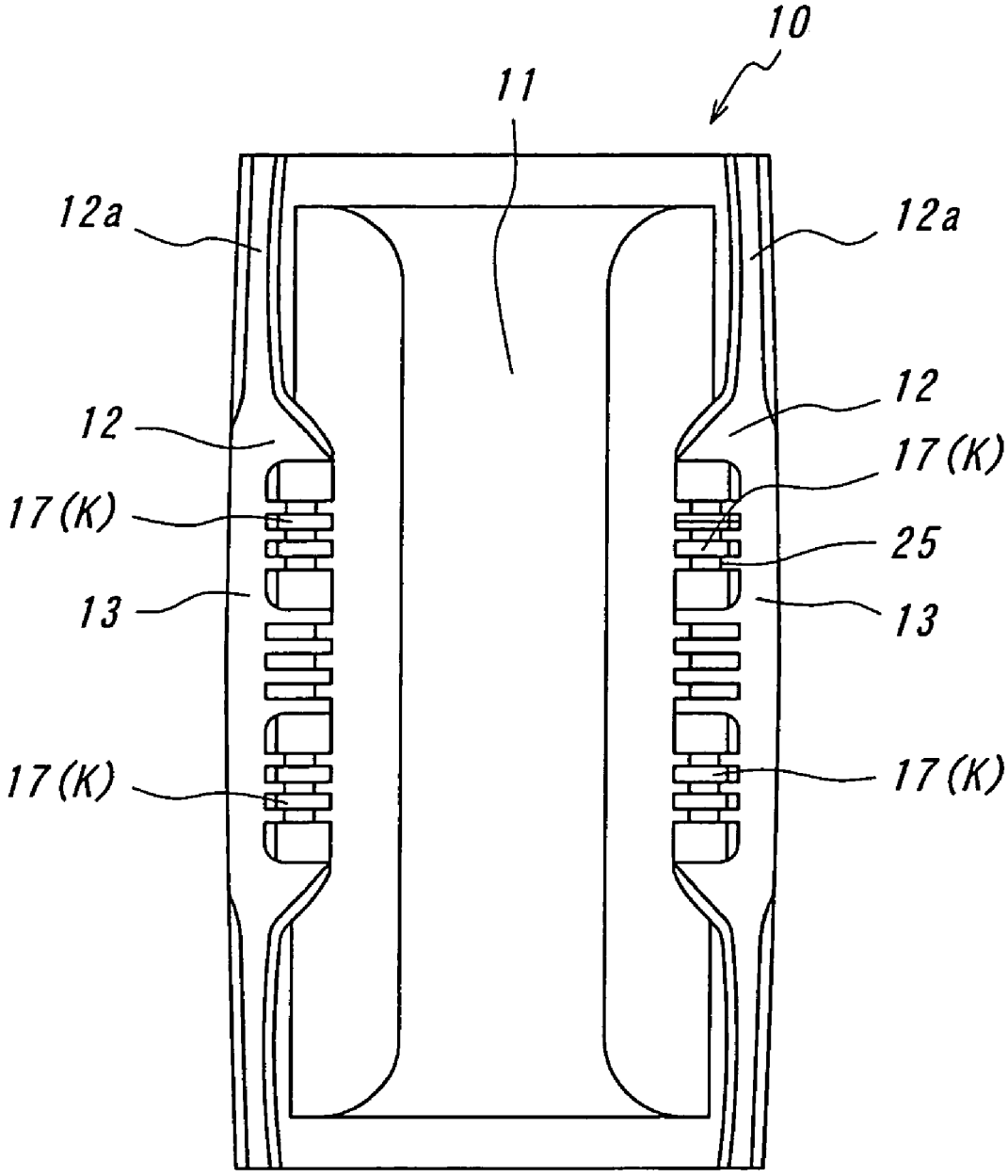
FIG. 5 is a front view of a grip used in the embodiment depicted in FIG. 1.
Figure 6:
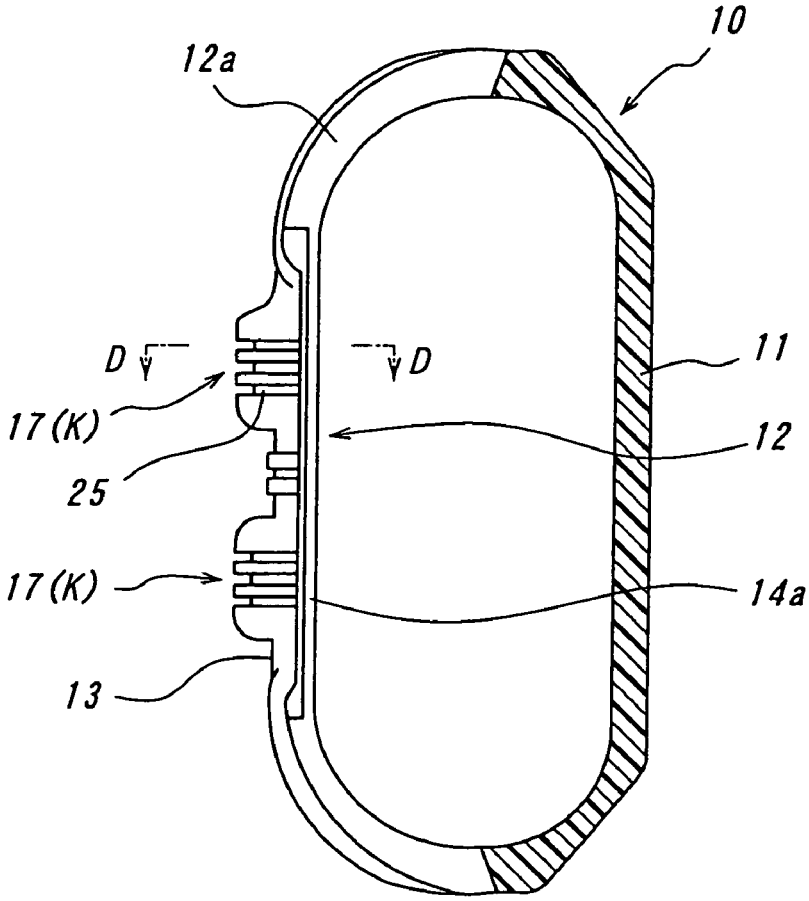
FIG. 6 is a vertical cross-sectional view of the grip taken along line C—C in FIG. 3.
Figure 7:
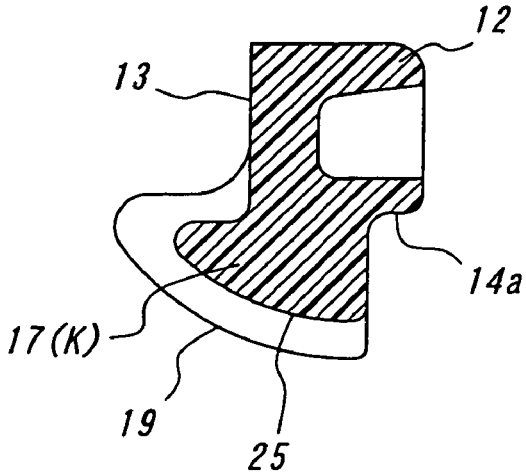
FIG. 7 is a cross-sectional view of a primary part taken along line D—D in FIG. 6.

FIGS. 5 to 7 show the grip 10, a pair of assembled beam pieces 12 having a linear rod shape are provided in parallel between upper and lower ends of a grip plate 11 having a vertical plate shape through coupling leg pieces 12*a* having a curved rod shape, and a fitting projection 17, which is a conformation of a fitting protrusion K with a cross-section having a substantially right-angled-triangular shape, is provided in the vicinity of a corner portion formed by an opposing side surface 14*a* and an end surface 13 of each of the pair of assembled beam pieces 12 in such a manner that one side forming a right angle substantially vertically protrudes from the opposing side surface 14*a* and the other side substantially vertically protrudes from the end surface 13 of the assembled beam piece 12 (see FIG. 7).

It is to be noted that the fitting projection 17 has a double-chevron shape and lateral striations 25 are formed to the fitting projection 17 in order to improve the sliding properties with respect to a preform P (see FIG. 6).

Figure 3:
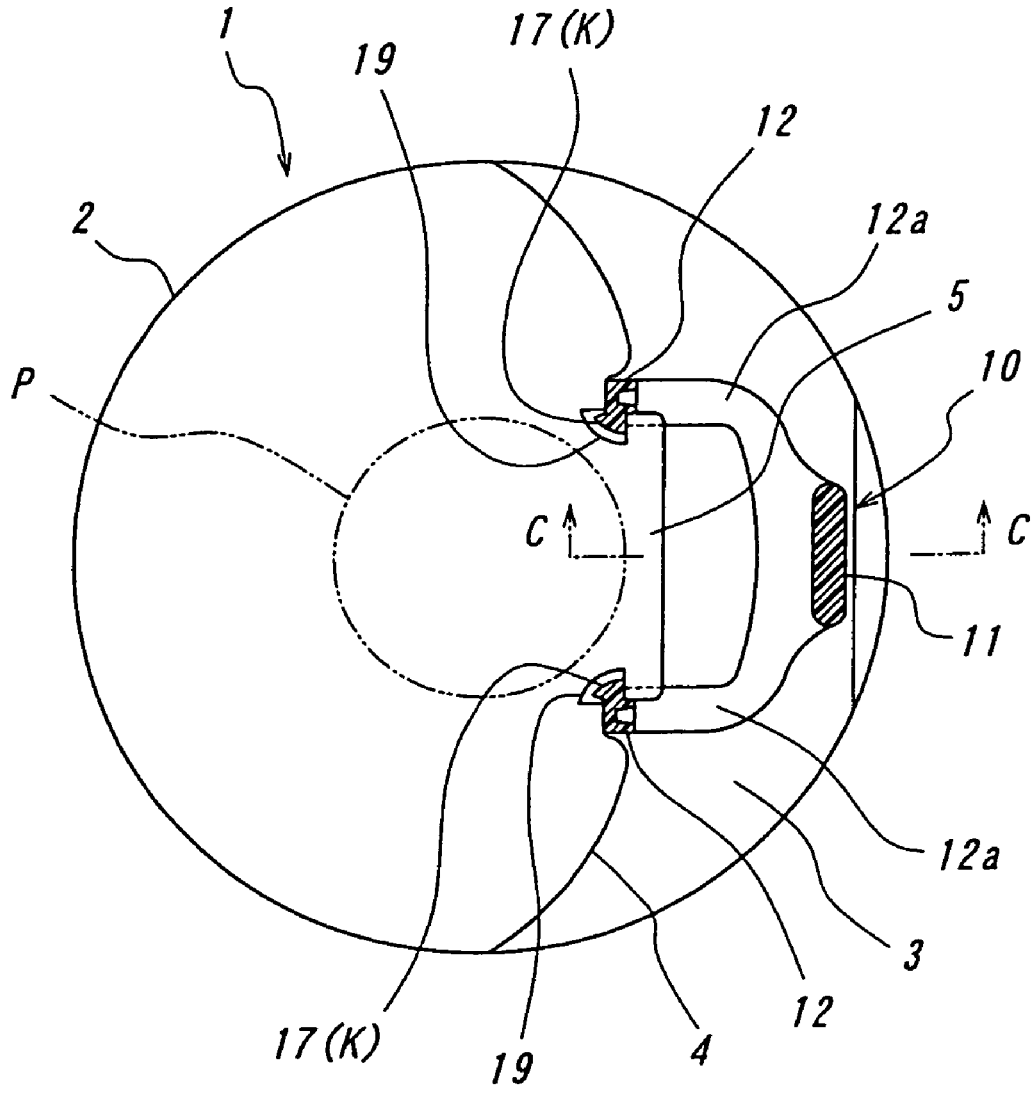
FIG. 3 is a cross-sectional view taken along line A—A in FIG. 1.

Although assembling of the grip 10 into the bottle main body 1 is achieved by subjecting the bottle main body 1 to a biaxial-stretch blow molding with the grip 10 as an insert material, the PET preform P swelled by air blow first comes into contact with a projection end surface 19 formed into a gradual arc shape on a drawing initial stage and covers this projection end surface 19, and the PET resin is then caused to flow along the outer peripheral surface of the fitting projection 17 with a cross-section having a simple substantially right-angled-triangular shape without producing a gap (see FIGS. 3 and 7).

The grip 10 is assembled and fixed to the bottle main body 1 such that the pair of assembled beam pieces 12 integrally provided to the grip plate 11 hold from the both sides a vertical protrusion 5 which protrudes at the center portion of the bottom surface 4 of the concave region 3 in the bottle main body 1 with each fitting projection 17 being used as a rigidly assembled portion having an undercut shape (see FIG. 3).

As shown in FIGS. 2*a* and 2*b*, a shoulder portion 8 of the bottle main body 1 according to this embodiment has a frustoconical shape at the upper portion thereof and a truncated pyramid shape at the lower portion thereof. A lower circumferential wall is formed of nine substantially trapezoidal panels 31, a vertical edge line 32 on the boundary between right and left adjacent panels 31, an upper edge line 33 on the boundary with the upper frustoconical portion 35 and a lower edge line 34 on the boundary with an upper end portion of the trunk portion 2 are formed in a network shape, and these edge lines perform a rib-like function which effectively disperses the load when it is applied.

Further, in this embodiment, of the nine panels 31 in total, four panels are symmetrically arranged on the front surface side of the bottle main body 1, whilst five panels are symmetrically arranged on the rear surface side of the same, and the right/left center axis of a rear surface panel 31*c* is placed at a position of a center angle 180° from the front surface with respect to the center axis of the bottle main body 1, i.e., at the center of the rear surface.

Figure 4:
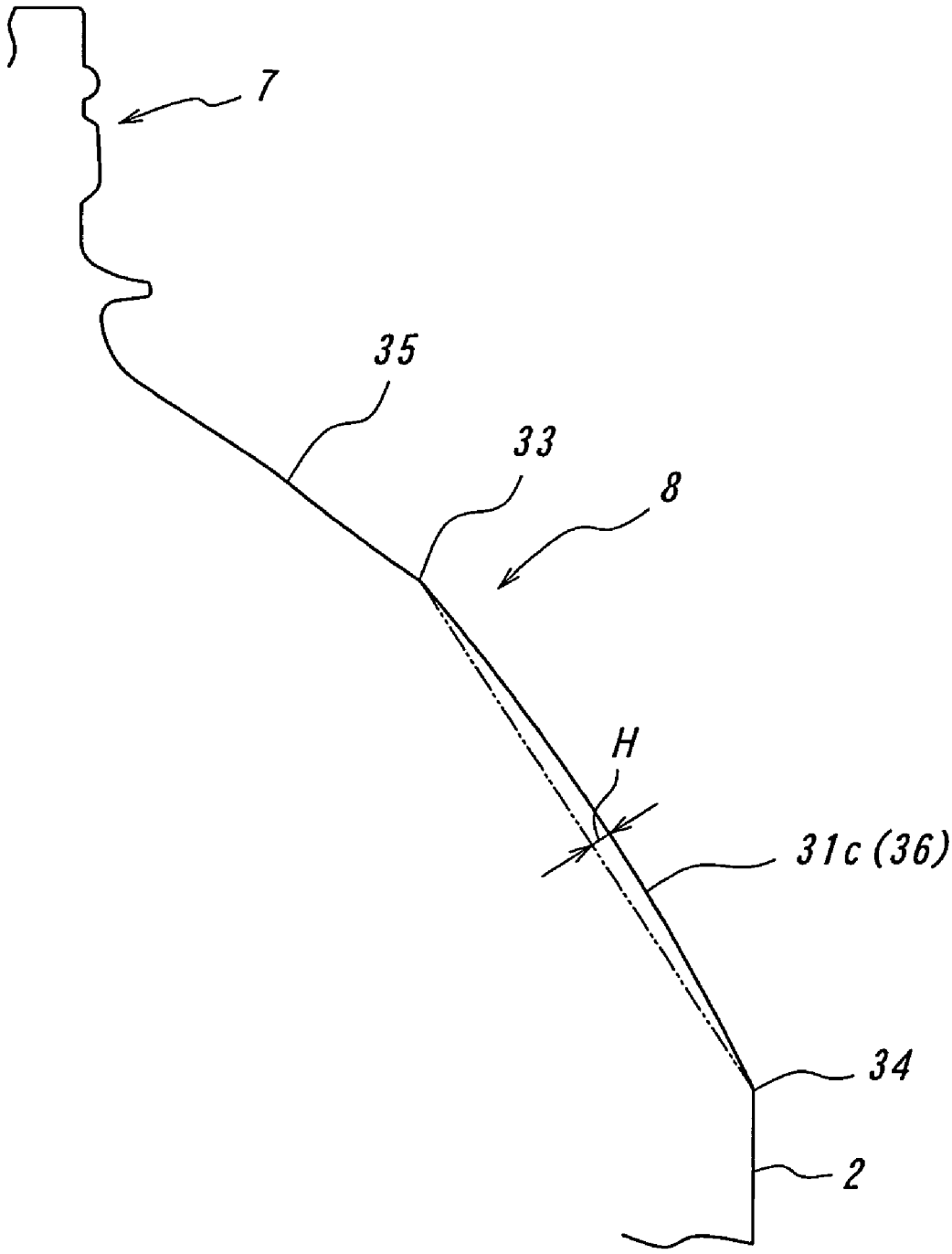
FIG. 4 is a schematic diagram showing an outer profile line taken along line B—B in FIG. 2*a*.

Each panel 31 has a center portion 36 formed as a protrusion having a convex shape gradually bulging toward the outside of the bottle main body 1. FIG. 4 shows a state of the projection portion at the right/left center axis of the rear surface center panel 31*c*, by way of example. In this embodiment, the height H of the protrusion is determined as 1 mm (see FIG. 4).

Figure 8A:
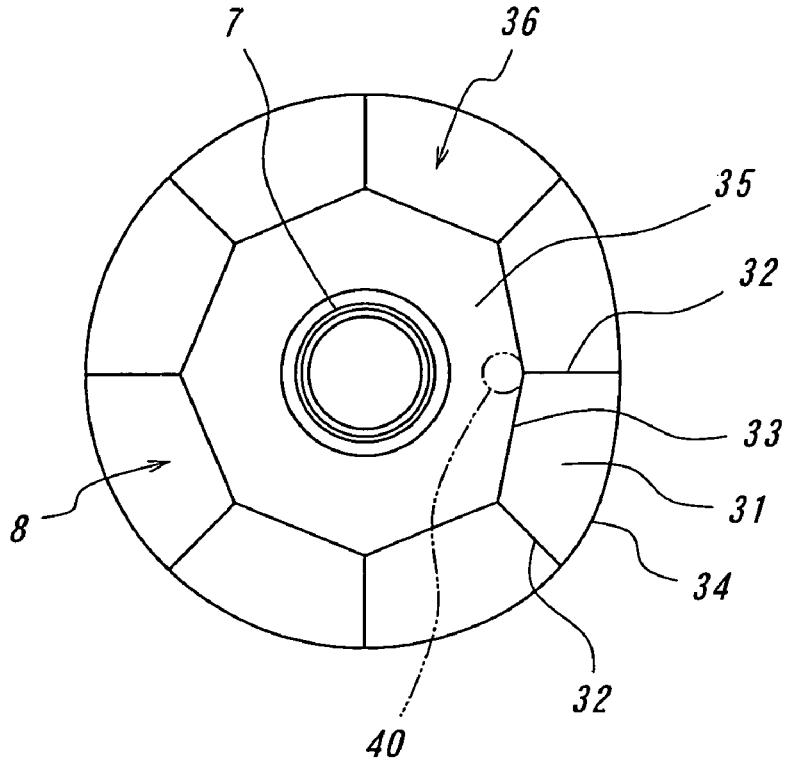
FIGS. 8*a* and 8*b* are plan view and a primary part side view showing a comparative example of the resin synthetic bottle with a grip, respectively.
Figure 8B:
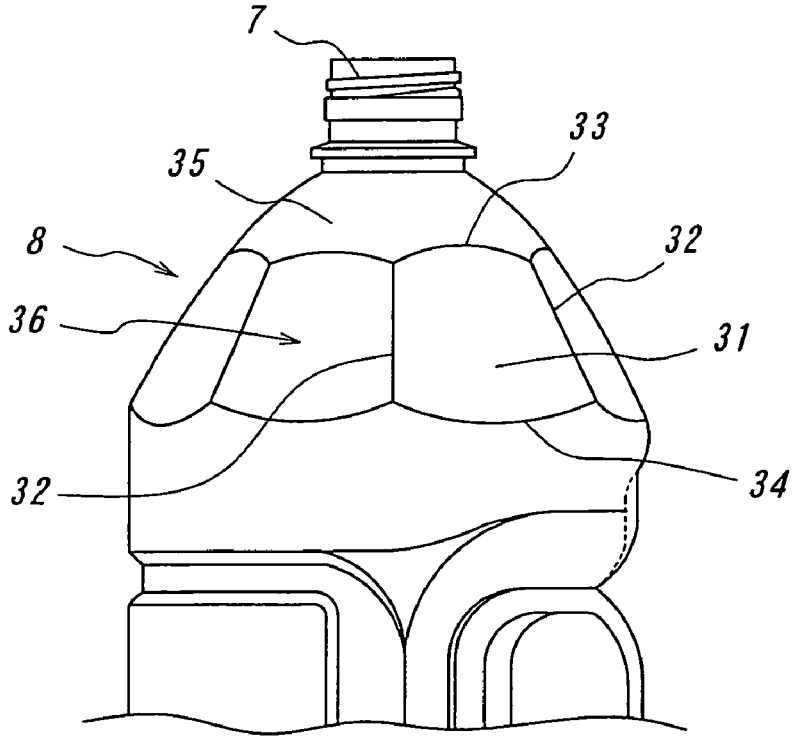

As a comparative example for the above-described embodiment, FIG. 8 shows a synthetic resin bottle with a grip in which four panels in a total of 8 panels 31 are symmetrically arranged on the front surface whilst four panels are symmetrically arranged on the rear surface and any other structure is the same as that of the embodiment as a comparative example with respect to the embodiment. In this case, one of vertical edge lines 32 formed by the boundary between adjacent panels is placed at a position of a center angle 180° from the front surface with respect to the center axis of the bottle main body 1, i.e., the center of the rear surface, and each panel 31 has a tabular shape which does not have a protrusion at the center thereof.

In order to verify the advantageous effects of the present invention, 4-litter bottles according to the embodiment and the comparative example were blow-molded, a load in the vertical direction was applied to each bottle, and the buckling strength was measured.

In the buckling strength measurement, the buckling was generated in the vicinity of an upper end of the vertical edge line 32 placed at the center portion of the rear surface in the bottle according to the comparative example (see the buckling generation portion 40 in FIG. 2*a*), whereas the buckling was generated in the vicinity of an upper end portion of each of a pair of right and left edge lines 32 in the rear surface panel 31*c* in the bottle according to the embodiment of the present invention (see a buckling generation portion 40 in FIG. 2*a*), and the stress dispersion effect by arrangement of the panels 31 based on the present invention was confirmed. Additionally, the buckling strength of the bottle according to the comparative example was approximately 40 Kgf, whereas the buckling strength of the bottle according to the embodiment of the present invention was 75 Kgf, and hence it was confirmed that the buckling strength can be improved to approximately 1.9-fold according to the present invention.

Although the present invention has been described with reference to the preferred embodiment, it is needless to say that the present invention may be carried out with various conformations other than those described above, without departing from the scope of the invention.

For example, the present invention is not limited to the bottle main body 1 or the grip shape described with reference to the foregoing embodiment, and the effect and advantage of the present invention can be generally demonstrated in a bottle having a concave region by which the grip 10 is attached on the rear side of the bottle main body 1, and the sufficiently high buckling strength can be likewise achieved in a large bottle having a concave region formed thereto.

Furthermore, in regard to the panels 31, the effect and advantage of the present invention can be generally demonstrated by forming each panel 31 whose center portion is formed as a protrusion having a gradual convex shape and arranging the panels 31 in such a manner that the right/left center axis of the rear surface panel 31*c* is placed at the center of the rear surface of the bottle main body 1, and the number and arrangement positions of the panels 31 can be appropriately determined while comprehensively taking a level of an improvement in the buckling strength as well as an appearance of the bottle, the moldability of the bottle main body 1 and others into account.

The invention claimed is:

1. A synthetic resin bottle with a grip, wherein a bottle main body including a substantially cylindrical trunk portion is formed with a concave region at a rear part of the trunk portion, and a grip is assembled and fixed in an upright orientation to a center position of the concave region at a rear surface side of the bottle main body: wherein a shoulder portion in the bottle main body has a lower circumferential wall with a truncated pyramid shape defined by a plurality of panels including a rear surface panel; wherein a right/left center axis of the rear surface panel is placed at substantially the center of the rear surface of the bottle main body; and wherein a center portion of each of the panels is formed as a protrusion having a convex shape gradually bulging outwards of the bottle main body.

2. The synthetic resin bottle according to claim 1, wherein even-numbered panels are symmetrically arranged on a front half side of the bottle main body, and odd-numbered panels are symmetrically arranged on a rear half side thereof.

3. The synthetic resin bottle according to claim 2, wherein four panels are symmetrically arranged on the front half side of the bottle main body, and five panels are symmetrically arranged on the rear half side of the same.

4. The synthetic resin bottle according to claim 1 wherein the protrusion at the center portion of the panel has a height of 0.2 to 2 mm.

5. The synthetic resin bottle according to claim 1 wherein the bottle main body has a shape in which a vertical protrusion is provided at a center portion of a concave bottom surface of the concave region, the grip is formed into a shape in which a grip plate is integrally provided between upper and lower ends of a pair of assembled beam pieces arranged in an upright orientation in parallel with each other, and a fitting protrusion serving as a rigidly assembled portion having an undercut shape with respect to the concave bottom surface of the bottle main body is provided to each of the pair of assembled beam pieces, and a part of the assembled beam piece and the fitting protrusion constitute an insert portion with respect to the part of the concave bottom surface close to the vertical protrusion of the bottle main body.

6. The synthetic resin bottle according to claim 5, wherein a fitting projection with a substantially right-angled-triangular cross-section is provided to the fitting protrusion in the vicinity of a corner portion formed by an opposing side surface and an end surface of each of the pair of assembled beam pieces so that one of the sides forming a right angle substantially vertically protrudes from the opposing side surface and the other side substantially vertically protrudes from the end surface.

7. The synthetic resin bottle according to claim 2, wherein the protrusion at the center portion of the panel has a height of 0.2 to 2 mm.

8. The synthetic resin bottle according to claim 3, wherein the protrusion at the center portion of the panel has a height of 0.2 to 2 mm.

9. The synthetic resin bottle according to claim 2, wherein the bottle main body has a shape in which a vertical protrusion is provided at a center portion of a concave bottom surface of the concave region, the grip is formed into a shape in which a grip plate is integrally provided between upper and lower ends of a pair of assembled beam pieces arranged in an upright orientation in parallel with each other, and a fitting protrusion serving as a rigidly assembled portion having an undercut shape with respect to the concave bottom surface of the bottle main body is provided to each of the pair of assembled beam pieces, and a part of the assembled beam piece and the fitting protrusion constitute an insert portion with respect to the part of the concave bottom surface close to the vertical protrusion of the bottle main body.

10. The synthetic resin bottle according to claim 3, wherein the bottle main body has a shape in which a vertical protrusion is provided at a center portion of a concave bottom surface of the concave region, the grip is formed into a shape in which a grip plate is integrally provided between upper and lower ends of a pair of assembled beam pieces arranged in an upright orientation in parallel with each other, and a fitting protrusion serving as a rigidly assembled portion having an undercut shape with respect to the concave bottom surface of the bottle main body is provided to each of the pair of assembled beam pieces, and a part of the assembled beam piece and the fitting protrusion constitute an insert portion with respect to the part of the concave bottom surface close to the vertical protrusion of the bottle main body.

11. The synthetic resin bottle according to claim 4, wherein the bottle main body has a shape in which a vertical protrusion is provided at a center portion of a concave bottom surface of the concave region, the grip is formed into a shape in which a grip plate is integrally provided between upper and lower ends of a pair of assembled beam pieces arranged in an upright orientation in parallel with each other, and a fitting protrusion serving as a rigidly assembled portion having an undercut shape with respect to the concave bottom surface of the bottle main body is provided to each of the pair of assembled beam pieces, and a part of the assembled beam piece and the fitting protrusion constitute an insert portion with respect to the part of the concave bottom surface close to the vertical protrusion of the bottle main body.

* * * * *